US006530632B1

(12) United States Patent
Writt

(10) Patent No.: US 6,530,632 B1
(45) Date of Patent: Mar. 11, 2003

(54) METHOD AND APPARATUS FOR ENVELOPE PRINTING WITH AN INK JET PRINTER

(75) Inventor: John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/767,045

(22) Filed: Jan. 22, 2001

(51) Int. Cl.[7] ..... B41J 3/00; B41J 2/30
(52) U.S. Cl. ..... 347/2; 400/124.05
(58) Field of Search ..... 347/14, 101, 19, 347/105, 106, 2, 16; 400/124.05, 88, 578, 582, 583.4

(56) References Cited

U.S. PATENT DOCUMENTS

| | | | | |
|---|---|---|---|---|
| 4,067,566 A | | 1/1978 | Williams | 271/2 |
| 4,186,659 A | | 2/1980 | Rogers et al. | 101/47 |
| 4,340,314 A | | 7/1982 | Berger | 400/625 |
| 4,362,100 A | | 12/1982 | Wu et al. | 101/233 |
| 4,431,323 A | | 2/1984 | Kulow | 400/625 |
| 5,069,434 A | | 12/1991 | Sellers | 271/2 |
| 5,080,509 A | | 1/1992 | Stone | 400/23 |
| 5,116,034 A | | 5/1992 | Trask et al. | 271/2 |
| 5,188,464 A | | 2/1993 | Aaron | 400/103 |
| 5,312,196 A | | 5/1994 | Hock et al. | 400/624 |
| 5,326,181 A | | 7/1994 | Eisner et al. | 400/64 |
| 5,450,187 A | | 9/1995 | Pei et al. | 399/45 |
| 5,549,290 A | | 8/1996 | Long et al. | 271/166 |
| 5,595,380 A | | 1/1997 | McCue, Jr. et al. | 271/9.09 |
| 5,829,895 A | * | 11/1998 | Hayashi et al. | 400/124.05 |
| 5,842,801 A | | 12/1998 | Myung | 400/700 |
| 6,002,095 A | | 12/1999 | Bodie et al. | 209/584 |
| 6,007,063 A | | 12/1999 | Park | 271/273 |
| 6,315,470 B1 | * | 11/2001 | Vaghi | 400/88 |

* cited by examiner

*Primary Examiner*—Lamson Nguyen
*Assistant Examiner*—Juanita Stephens
(74) *Attorney, Agent, or Firm*—Elizabeth C. Jacobs

(57) ABSTRACT

An inkjet printer having an envelope comer printing apparatus that prints print data on the comer of an envelope independently from the printing function performed by the printer with respect to the sheet media printed by the printer. The printer housing includes a slot in a front corner positioned to receive an envelope corner for purposes of printing print data such as a return address or postage on the envelope corner. The printhead of the printer is capable of being positioned over the slot in the front corner of the printer housing and a sensor located within the printer housing near the slot detects the insertion of the envelope corner and initiates printing by the printhead. The printhead prints the print data from the non-volatile memory of the printer and does not require constant interfacing between the printer and the computer attached to the printer.

26 Claims, 5 Drawing Sheets

METHOD AND APPARATUS FOR ENVELOPE PRINTING WITH AN INK JET PRINTER

TECHNICAL FIELD

The present invention relates to a method and apparatus for printing print data on the corner of an envelope with an ink-jet printer and, more particularly, to an ink-jet printer having an envelope corner printing apparatus that prints print data on the corner of an envelope independently from the printing function performed by the printer with respect to the sheet media printed by the printer. The printer housing includes a slot in a front corner positioned to receive an envelope corner for purposes of printing print data such as a return address or postage on the envelope corner. The printhead of the printer is capable of being positioned over the slot in the front corner of the printer housing by traversing the width of the printer housing along a guide rod. A sensor located within the printer housing near the slot detects the insertion of the envelope corner and initiates printing by the printhead. Spring clips positioned within the slot stabilize the envelope corner at the proper distance from the printhead to ensure the proper gap distance between the ink-ejecting nozzles of the printhead and the surface of the envelope. The printhead prints the print data from the nonvolatile memory of the printer and does not require constant interfacing between the printer and the computer attached to the printer.

BACKGROUND ART

In using conventional ink-jet printers, it is desirable to be able to print static print data such as return address information and postage information on the corner of envelopes without significant effort and reconfiguration of the printer's print path used to print on sheet media. Some efforts to develop devices to print such print data on envelope corners has included the use of adjustable paper trays or feeders on the printer that permit the insertion of envelopes and the transport of the envelopes through the printer's sheet media print path. By interacting with a user's computer attached to the printer, the desired print data is communicated to the printhead and printed on the envelope as the envelope passes through the printing area of the sheet media print path. Using such devices, the print data can typically be printed both on the envelope corners as well as on the middle portion of the envelopes. Unfortunately, such devices may require the printer to continuously interface with the user's computer in order to obtain the print data that the user desires to be printed on the envelope or such devices may require the user to adjust various controls on the printer itself. Also, such devices can be cumbersome and require the user to often adjust the envelope in the paper tray to ensure that the envelope is aligned properly in the tray for purposes of feeding through the printer's sheet media print path. This can be particularly problematic when the envelopes are of variable sizes or are stuffed with contents.

Other devices developed to print data on envelope corners include the use of a entirely separate printing device from the printer to store such print data and print such print data on envelope corners. Although such printing devices may more easily print the print data on envelope corners than conventional ink-jet printers, such devices can be expensive and may take up additional desk space that is useful to the user. The user often prefers the use of a single printer to perform both the functions of printing print data on sheet media as well as on the corner of envelopes. These devices can also be problematic for printing on variably sized envelopes or stuffed envelopes.

Thus, there has arisen a need in the industry for an ink-jet printer that includes an envelope corner printing apparatus that enables a user to print data on the corner of an envelope without requiring adjustment of the printer's sheet media print path and performs such printing on the printer itself rather than requiring an entirely separate printing device. It would also be advantageous to perform such printing on envelope corners without requiring constant interfacing between the printer and the computer attached to the printer, but rather can access print data stored in the printer's local non-volatile memory.

DISCLOSURE OF INVENTION

An ink-jet printer having the envelope corner printing apparatus of the present invention provides for the printing of print data on the corner of envelopes in low-volume printing applications while eliminating many of the drawbacks associated with printing on envelope corners caused by conventional ink-jet printers.

An ink-jet printer includes a conventional sheet media print path. The sheet media print path is defined by a paper tray for storing the sheet media, a set of rollers that transport the sheet media from the sheet media input slot in the printer housing to the printing area for printing, a second set of rollers that advance the media and stabilize the media in the printing area, a third set of rollers that transport the sheet media from the printing area out of the printer through a sheet media output slot, and a backing tray for receiving the printed sheet media. An ink-jet printer including the envelope corner printing apparatus of the present invention also includes an additional slot located in a front corner of the printer housing that is separate from the sheet media input slot and the sheet media output slot. The slot is of sufficient width and dimensions to receive the corner of an envelope. The slot is positioned such that the printhead of the printer is able to traverse the width of the printer housing along a guide rod and become positioned just above the slot. A sensor located within the printer housing near the slot detects the insertion of the envelope corner and sends a signal to the printer main electronics that initiates printing on the envelope corner by the printhead. Spring clips positioned within the slot stabilize the envelope corner at the proper distance from the printhead to ensure the proper gap distance between the ink-ejecting nozzles of the printhead and the surface of the envelope. The printhead prints the print data from the non-volatile memory of the printer and does not require continuous interfacing between the printer and the computer attached to the printer. For purposes of the invention, the print data may include any type of information that a user wishes to print on an envelope corner that does not require constant communication with the printer's computer, but typically such print data will include return address information of the user or postage information. In order to modify the print data stored in the printer's non-volatile memory, the user can enter certain commands in the user's computer and briefly interface with the printer to update the printer's non-volatile memory. It is not practical to use the envelope corner printing apparatus of the present invention to attempt to print mailing address information on the middle portion of envelopes, but rather such mailing address information will continue to be printed by a printer including the envelope corner printing apparatus of the present invention through the printer's sheet media print path.

It is an object of the present invention to provide for the easy printing of print data such as return address information and postage information on the corner of an envelope without requiring the reconfiguration of the printer's sheet media print path, without requiring constant interfacing with the computer attached to the printer and without the use of a separate printing device. It is a further object of the present invention to be capable of performing such printing on envelope corners for any size envelope and for stuffed envelopes.

These and other features and advantages of the present invention will become apparent from the following detailed description, the accompanying drawings and the appended claims.

BEST MODE FOR CARRYING OUT THE INVENTION

Figure 1:
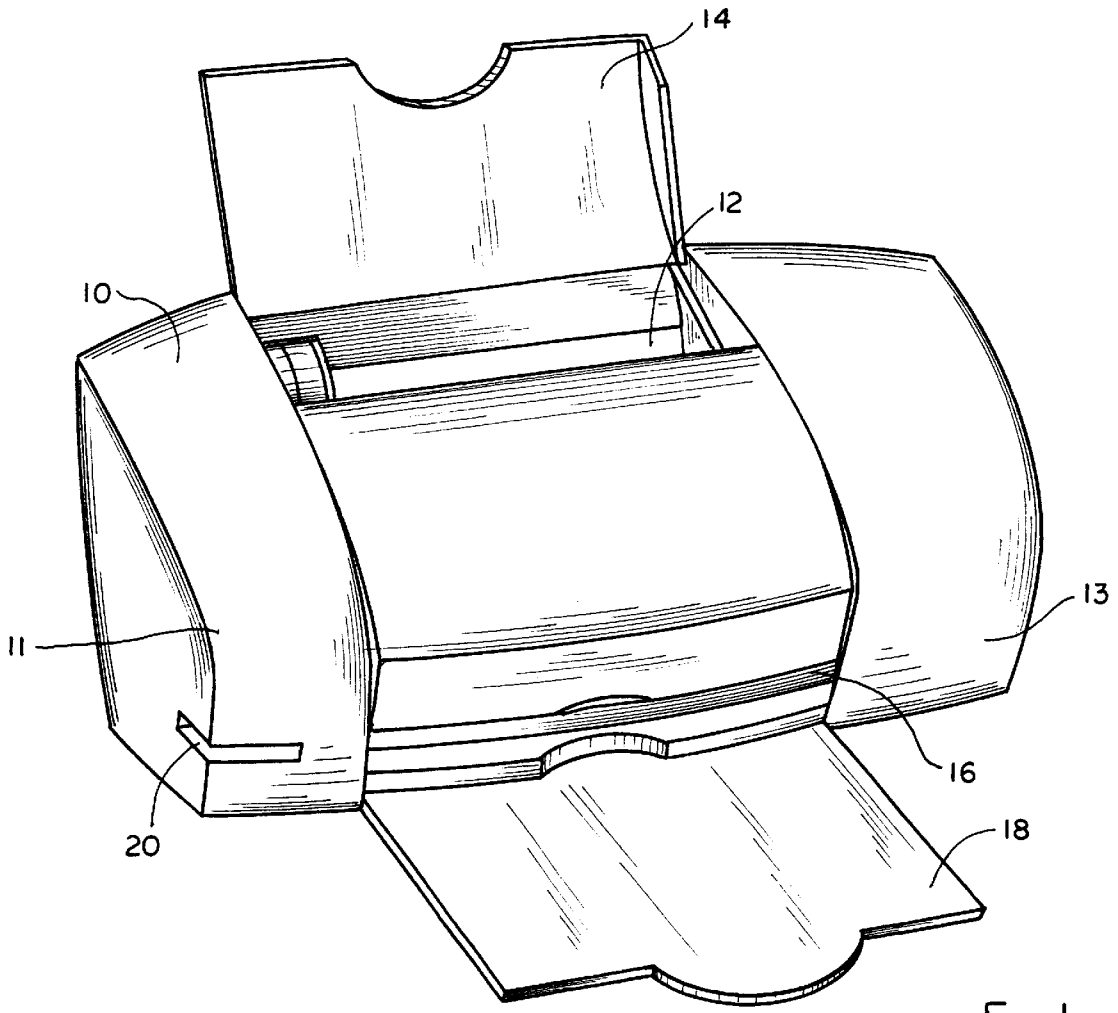
FIG. 1 is a perspective view of an ink-jet printer including the envelope corner printing apparatus of the present invention.

FIGS. 1–4 illustrate the preferred embodiment of the apparatus and method of the present invention. As shown in FIG. 1, an ink-jet printer incorporating the envelope corner printing apparatus of the present invention includes a housing 10 and a sheet media input slot 12 for insertion of a printer tray 14. The printer tray 14 is designed to store standard sheet media and feeds the sheet media through the sheet media input slot 12 for printing. The printer further includes a sheet media output slot 16 for outputting the sheet media after printing. A backing tray 18 receives the printed sheet media from the sheet media output slot 16 for holding until removed from the printer by a user. A computer (not shown) is connected to the printer for continuously communicating print data to the printer for printing on the sheet media.

The envelope corner printing apparatus of the present invention requires a slot 20 in the housing 10 of the printer. In the preferred embodiment, the slot 20 is located at a single front corner of the housing 10 either in the front left corner portion of the housing 11 or the front right corner portion of the housing 13. The decision to locate the slot 20 in either the front left corner portion of the housing 11 or the front right corner portion of the housing 13 would typically depend on the user's preference and the location of the printhead capping station. The slot 20 is positioned in substantially the same horizontal plane of the housing 10 as the sheet media output slot 16.

Figure 2:
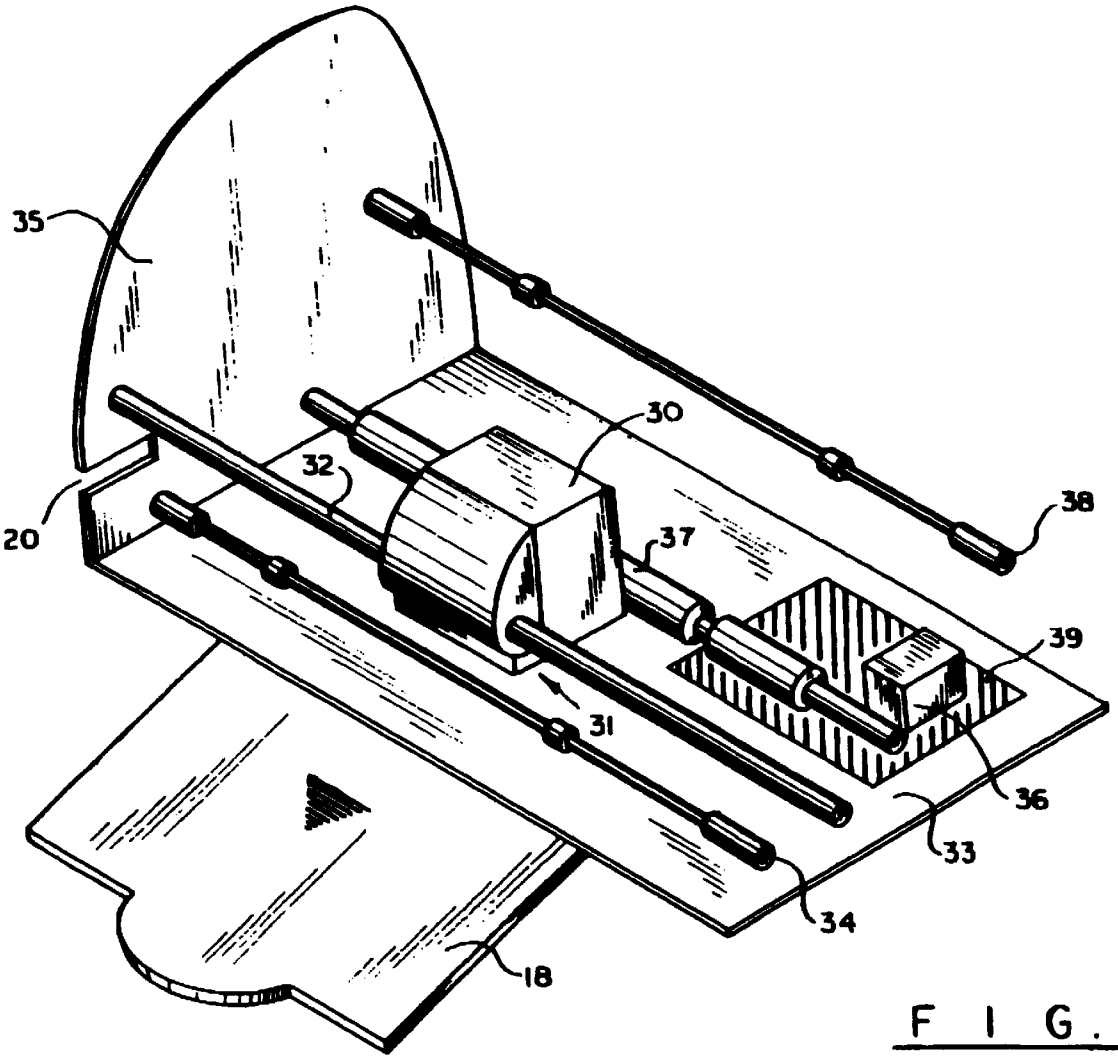
FIG. 2 is a perspective view of a portion of an ink-jet printer including the envelope printing apparatus of the present invention showing the printhead positioned over the printer's sheet media print path.
Figure 3:
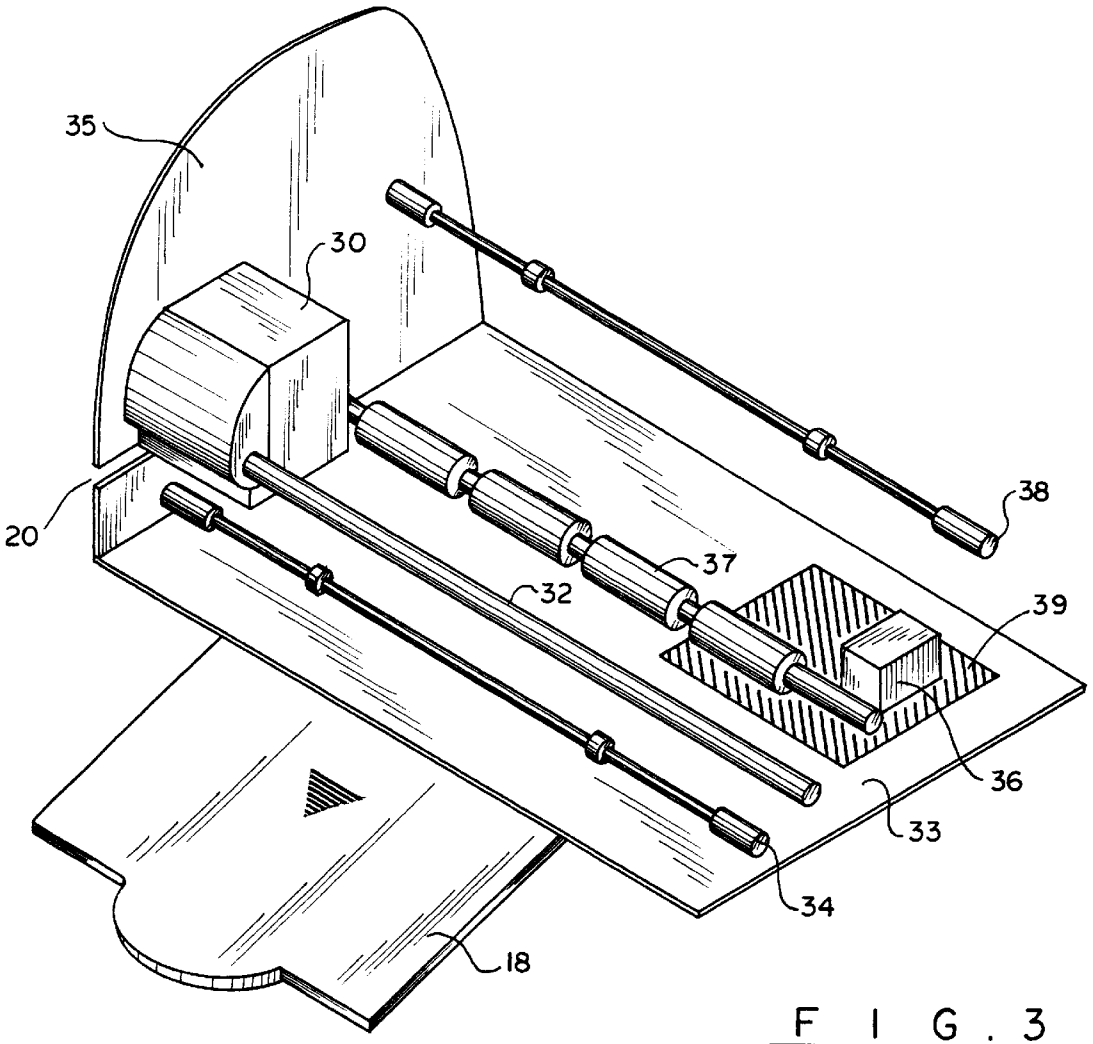
FIG. 3 is a perspective view of a portion of an ink-jet printer including the envelope printing apparatus of the present invention showing the printhead positioned for printing on envelope corners in accordance with the present invention.

As shown in FIG. 2, inside the housing 10, an ink-jet printer generally includes a printhead 30 that during operation traverses the width of the housing 10 along the guide rod 32. FIG. 2 shows the inside of the bottom wall of the housing 33 and the inside of the sidewall of the housing 35 including the slot 20. The printer includes a sheet media print path that the sheet media will travel along during printing. The sheet media print path is defined by the paper tray 14 for storing the sheet media, a first set of rollers, one roller of which is indicated at 38, that transport the sheet media from the sheet media input slot 12 to the printing area for printing, a second set of rollers, one roller of which is indicated at 37, that advance the sheet media and stabilize the sheet media in the printing area, and a third set of rollers, one roller of which is indicated at 34, that transport the printed sheet media from the printing area out through the sheet media output slot 16, and a backing tray 18 for receiving the printed sheet media and holding until retrieved by the user. The printing area is defined as that part of the sheet media print path in which the sheet media is positioned under the printhead 30 for printing and is indicated generally at 31. When printing in the normal printing mode, the sheet media is transported through sheet media input slot 12 by the rollers 38 to the rollers 37 and the printing area. Additional rollers and elements contained within the housing 10 have been eliminated from FIG. 2 for purposes of clarity. As the sheet media passes under the printhead 30, the printhead traverses the sheet media along guide bar 32 printing a swathe of print data on the sheet media in a conventional manner. The printhead 30 moves back and forth along the guide bar 32 to define a printing area generally consistent with the width of the print media. The printed sheet media is then passed under the rollers 34 and output through the sheet media output slot 16. The printed sheet media is received by the backing tray 18 until removed from the printer by the user. During printing in the normal printing mode, the print data is communicated to the printhead 30 from the printer main electronics 39. The printer main electronics 39 is in communication with a computer and receives the print data from the computer. The printer main electronics 39 contains various electronic components and non-volatile memory 36 that is capable of storing the print data.

When an envelope corner is inserted into slot 20, the presence of the envelope corner is automatically detected by the printer. When an envelope corner is detected, the printhead 30 is transported along the guide bar 32 to a position above the slot 20 shown generally in FIG. 3. With the envelope corner inserted into slot 20, the printhead 30 is passed above slot 20 along guide bar 32 and prints one line or more of print data on the envelope corner. The source of this print data is the non-volatile memory 36 on the printer main electronics 39. If an envelope corner is inserted into the slot 20 during a normal print job, the printer may either wait and print on the envelope corner after the completion of the print job, or the printer may print the single swath onto the envelope corner during the print job.

Figure 4:
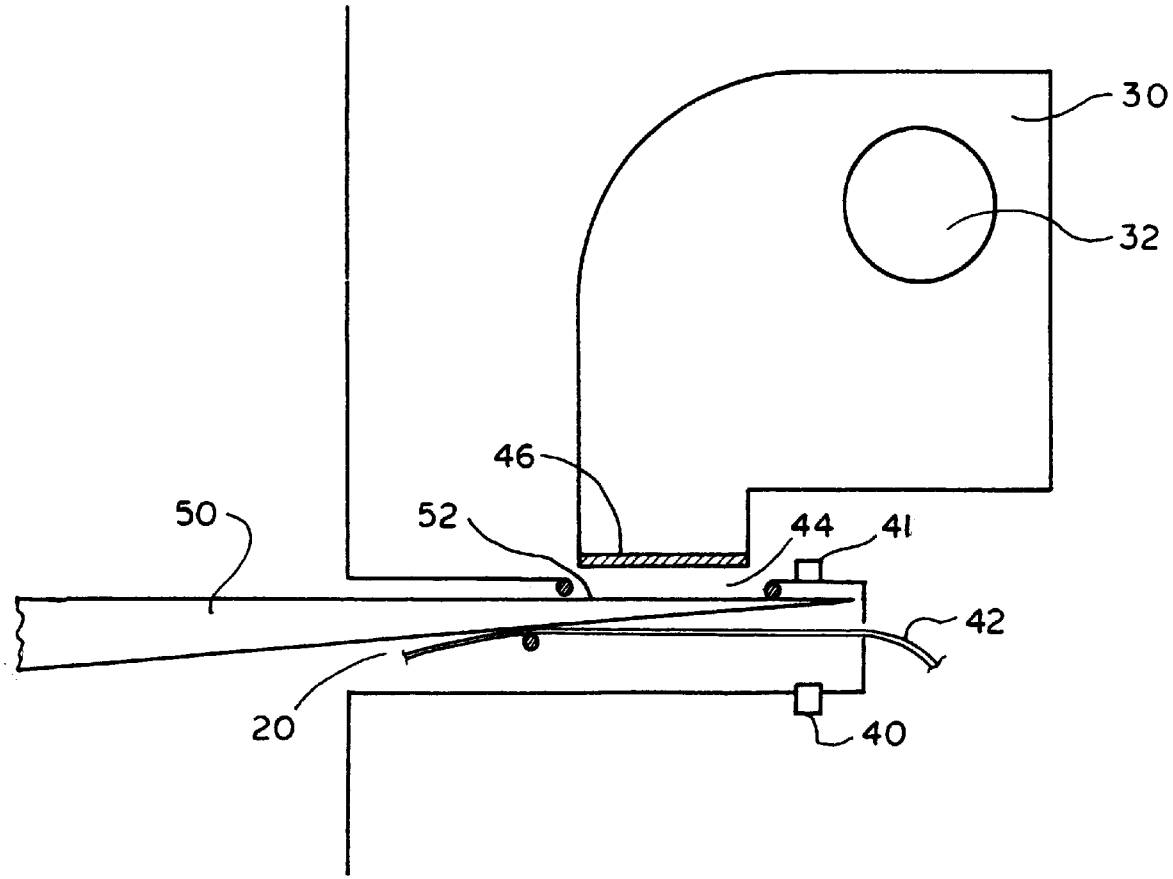
FIG. 4 is a perspective view of a portion of the envelope corner printing apparatus of the present invention showing an envelope corner positioned for printing.

FIG. 4 shows portions of the preferred embodiment of the envelope corner printing apparatus of the present invention in greater detail. The envelope corner printing apparatus includes an optical emitter 40 and an optical sensor 41 positioned near the slot to detect the insertion of an envelope corner 50 into the slot 20. The optical emitter 40 emits a light signal to the optical sensor 41 located on the opposite side of the slot 20. One or more spring clips 42 are also positioned near the slot 20 to stabilize the envelope corner 50 upon insertion at the proper distance from the printhead 30. The printhead 30 includes an array of ink-ejecting nozzles, designed to be positioned slightly above the envelope corner 50 inserted into the slot. The cross-section of the guide bar 32 is shown and the guide bar 32 supports the printhead 30 over the slot 20. When an envelope corner 50 is inserted into the slot 20, the spring clip 42 engages the envelope corner 50 to ensure a proper gap distance 44 between the ink-ejecting nozzles 46 of the printhead and the upper surface 52 of the envelope. The slot 20 and the spring clip 42 are designed to accommodate an envelope corner 50 for an envelope that is either stuffed or empty. The slot 20 and the spring clip 42 are also designed to accommodate an envelope corner 50 independently of the envelope size and dimensions.

In response to the insertion of the envelope corner 50, the light signal transmitted from the optical emitter 40 to the optical sensor 41 is broken and the optical sensor 41 sends a signal to the printer main electronics 39 to initiate printing. After each printing and each printed envelope corner 50 is removed from the slot 20, the optical sensor 41 resets itself. Alternatively, by locating the optical sensor 41 on the same side of the slot 20 as the optical emitter 40, a signal could be generated by the reflection of the light signal off of the envelope corner 50 rather than from the breakage of the light signal. In either case, the printer main electronics 39 initiates printing in response to the generation of such signal.

The print data printed by the printhead 30 is the print data that is stored in a specific location in the printer's non-volatile memory 36. The printhead receives such print data from the printer's non-volatile memory 36 upon the detection of an envelope corner 50 in slot 20. The printhead 30 performs such printing of the print data without having to continuously interface with the user's computer. Communication between the printer and the user's computer is necessary, however, to modify the print data in the printer's non-volatile memory 36.

Figure 5:
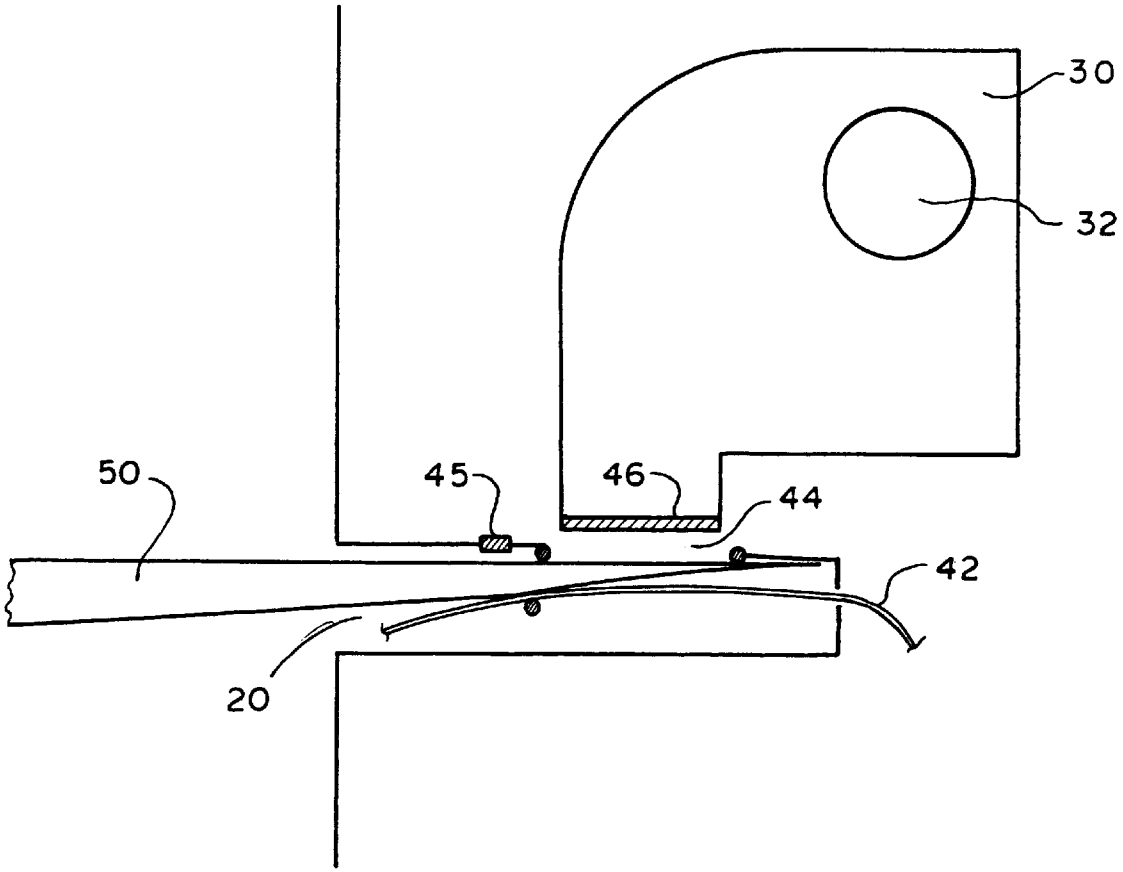
FIG. 5 is a perspective view of an alternative embodiment of a portion of the envelope corner printing apparatus of the present invention.

An alternative embodiment of the envelope sensing portion of the envelope corner printing apparatus of the present invention is shown in FIG. 5. In FIG. 5, the combination of the optical emitter 40 and the optical sensor 41 is replaced by the use of a spring clip 42 as an electrical contact switch to detect the presence of the envelope corner 50. The spring clip 42 is in electrical contact with a conductive sensor 45 until the insertion of envelope corner 50 separates the end of the spring clip 42 from the conductive sensor 45 to indicate the presence of the envelope corner 50. The separation at the end of the spring clip 42 from the conductive sensor 45 sends a signal to the printer main electronics 39 and this initiates printing in accordance with the invention.

Although in the preferred embodiment, the print data will include return address information or postage information, other information could be printed. Return address information and postage information are particularly suited for the invention because such print data rarely changes for a user over a number of print jobs. Nevertheless, when a user does wish to modify the print data, the user using the computer connected to the printer can access the memory location in the printer's non-volatile memory 36 for such print data and make the modifications. The next time that the printer detects an envelope corner 50 in slot 20, the printhead 30 will retrieve the print data in its updated and modified form from the printer's non-volatile memory 36.

Although a preferred embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

Industrial Applicability

An ink-jet printer having the envelope printing apparatus of the present invention may be useful for a number of various business applications. The present invention provides for the easy printing of print data such as return address information and postage information on envelope corners without requiring constant interfacing with a computer and without requiring the use of a separate device. Thus, the time and expense of printing print data on envelope corners is significantly reduced. Also, the envelope printing apparatus of the present invention allows for the printing of print data on the corner of oversized envelopes and stuffed envelopes. The type of print data appropriate for printing with the present invention may include other types of information in addition to return address information and postage information if the information printed will remain the same for a number of repeated printings.

What is claimed is:

1. An envelope printing apparatus for printing print data on a corner of an envelope for use with an ink-jet printer having a housing and a sheet media print path, the envelope printing apparatus comprising:

a printhead that is capable of being moved to a position above a slot in the housing the slot separate from the sheet media print path;

printer main electronics having memory for storing print data;

the printhead capable of receiving the print data from the memory;

a sensor located within the housing near the slot and in communication with the printer main electronics for detecting insertion of the envelope corner and generating a signal in response to such insertion; and the printer main electronics, in response to the signal, directing the printhead to print the print data on the envelope corner.

2. The envelope printing apparatus of claim 1 further comprising one or more clips located near the slot within the housing for engaging the envelope corner inserted into the slot to position the envelope corner within the slot at a defined distance from the printhead.

3. The envelope corner printing apparatus of claim 1 wherein the slot is positioned in substantially the same horizontal plane of the housing as the printing area of the sheet media print path.

4. The envelope corner printing apparatus of claim 1 wherein the sensor is an optical sensor.

5. The envelope corner printing apparatus of claim 1 wherein the sensor is an electrical contact switch.

6. The envelope corner printing apparatus of claim 1 wherein the print data is return address information.

7. The envelope corner printing apparatus of claim 1 wherein the print data is postage information.

8. The envelope printing apparatus of claim 1 wherein the envelope is held stationary during printing.

9. The envelope printing apparatus of claim 1 wherein the slot is sized to only receive the corner of the envelope.

10. The envelope printing apparatus of claim 1 wherein the sheet media print path is partially defined by a set of rollers, the set of rollers transporting sheet media from the sheet media input slot through a printing area and out of the printer through a sheet media output slot.

11. A printer for printing print data on a corner of an envelope comprising:

a housing having a slot in the housing for receiving the corner of an envelope, the slot separate from a sheet media input slot in the housing providing access to a sheet media print path;

a printhead disposed in the housing and moveable along a guide bar extending the width of the housing, the printhead being able to become positioned above the slot;

printer main electronics having memory for storing print data;

the printhead capable of receiving the print data from the memory;

a sensor located within the housing near the slot for detecting insertion of the envelope corner into the slot and generating a signal in response to such insertion; and the printer main electronics, in response to the signal, directing the printhead to print the print data on the envelope corner.

12. The printer of claim 11 further comprising one or more clips located within the housing near the slot for engaging the envelope corner inserted into the slot to position the envelope corner within the slot at a defined distance from the printhead.

13. The printer of claim 11 wherein the sensor is an optical sensor.

14. The printer of claim 11 wherein the sensor is an electrical contact switch.

15. The printer of claim 11 wherein the slot is positioned in substantially the same horizontal plane of the housing as the printing area of the sheet media print path.

16. The printer of claim 11 wherein the print data is return address information.

17. The printer of claim 11 wherein the print data is postage information.

18. The printer of claim 11 wherein the envelope is held stationary during printing.

19. The printer of claim 11 wherein the slot is sized to only receive the envelope corner.

20. The printer of claim 11 wherein the sheet media print path is partially defined by a set of rollers, the set of rollers transporting sheet media from the sheet media input slot through a printing area and out of the printer through a sheet media output slot.

21. A method for printing print data on a corner of an envelope comprising the steps of:

storing print data to be printed on the envelope corner in memory located in the printer housing;

inserting the envelope corner into a slot in the printer housing that is separate from a sheet media input slot in the printer housing providing access to a sheet media print path in the printer;

sensing the insertion of the envelope corner into the slot;

generating a signal in response to such insertion;

retrieving the print data from the memory in response to the signal;

positioning the printhead of the printer above the slot; and printing the print data on the envelope corner.

22. The method of claim 21 wherein the print data is return address information.

23. The method of claim 21 wherein the print data is postage information.

24. The method of claim 21 wherein the envelope is held stationary during printing.

25. The method of claim 21 wherein the slot is sized to only receive the envelope corner.

26. The method of claim 21 wherein the sheet media print path is partially defined by a set of rollers, the set of rollers transporting sheet media from the sheet media input slot through a printing area and out of the printer through a sheet media output slot.

* * * * *